US007619213B2

(12) United States Patent
Li

(10) Patent No.: US 7,619,213 B2
(45) Date of Patent: Nov. 17, 2009

(54) ION EXTRACTION PULSER AND METHOD FOR MASS SPECTROMETRY

(75) Inventor: Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 475 days.

(21) Appl. No.: 11/499,177

(22) Filed: Aug. 3, 2006

(65) Prior Publication Data

US 2008/0029696 A1 Feb. 7, 2008

(51) Int. Cl.
*H01J 49/40* (2006.01)

(52) U.S. Cl. ..... 250/286; 250/281; 250/282; 250/287; 250/288; 250/292; 250/294; 250/396 R; 250/290

(58) Field of Classification Search ..... 250/281, 250/282, 287, 288, 286, 292, 294, 396 R, 250/290

See application file for complete search history.

(56) References Cited

U.S. PATENT DOCUMENTS 5,654,543 A * 8/1997 Li ..... 250/287
5,994,695 A 11/1999 Young
6,455,845 B1 * 9/2002 Li et al. ..... 250/287
6,717,133 B2 4/2004 Li

* cited by examiner

*Primary Examiner*—Jack I Berman
*Assistant Examiner*—Meenakshi S Sahu

(57) ABSTRACT

The invention provides an ion extraction pulser. The ion extraction pulser may be used independently or in conjunction with a mass spectrometry system. The mass spectrometry system includes an ion source for producing ions, an ion optics system downstream from the ion source for selecting and directing ions, and a detector down stream from the ion optics system for detecting the ions selected and directed by the ion optics system. The ion optics system includes one or more ion extraction pulsers. The ion extraction pulser includes a mesh plate for applying a pulse for extracting ions from an ion beam; a first filter plate adjacent to the mesh plate for filtering ions extracted by the mesh plate; a guard plate adjacent to the first filter plate for further directing ions filtered by the first filter plate; and a second filter plate adjacent to the first guard plate for further filtering ions directed from the guard plate The invention also provides methods for extracting, selecting and processing ions using ion extraction pulsers.

23 Claims, 4 Drawing Sheets

ION EXTRACTION PULSER AND METHOD FOR MASS SPECTROMETRY

BACKGROUND

Various devices have been designed for extracting and/or moving ions. These devices may be used in independent or in conjunction with a mass spectrometry system. One type of device that extracts and redirects ions is called a pulser.

Typical pulsers used in time-of-flight or other similar type detectors comprise one or more electrodes for extracting, selecting and moving ions. These devices typically work by sending an ion beam to the device. Once the beam reaches the device, the ion beam enters an extraction region bounded by one or more electrodes. As the ion beam passes the extraction region, a pulse is supplied by an electrode or other device to redirect the ions through one or more additional electrodes that will be used for further processing or selection of ions. The further processed or directed ions are then passed on to a downstream detector for detection and/or quantification of ions and species. In certain instances electrodes may be designed to provide both a "push" and/or "pull" on the ions provided by the ion beam. This may be accomplished with one or more electrodes in the device or system.

A major problem with these devices and systems concerns the issue of high capacitance of the electrode used for extracting, selecting and moving ions. This generally requires increased electrical power that provide for increased cost in operating the instrument. The large power required to operate the instrument often also requires more sophisticated or complex electric circuits. Lastly, large power supplies with high voltage often affect the overall ability of the device or system to achieve good resolving power.

These and other problems have been addressed by the present invention.

SUMMARY OF THE INVENTION

The present invention provides a mass spectrometry system, comprising an ion source for producing ions; an ion optics system downstream from the ion source for selecting and directing ions; and a detector down stream from the ion optics system for detecting the ions selected and directed by the ion optics system.

The invention also provides an ion extraction pulser, comprising a mesh plate for applying a pulse and electric field for extracting and re-directing ions from an ion beam; a first filter plate adjacent to the mesh plate for filtering ions extracted by the mesh plate; a guard plate adjacent to the first filter plate for further directing ions filtered by the first filter plate; and a second filter plate adjacent to the first guard plate for further filtering ions directed from the guard plate.

Lastly, the invention provides a method for filtering and extracting ions. The method for extracting and filtering ions from an ion beam comprises introducing an ion beam into a field region disposed between a mesh plate and a filter plate; applying a pulse to the mesh plate to direct the ions toward the filter plate for filtering; filtering the ions using the filter plate; moving the resulting filtered ions with a guard plate; filtering the moved ions using a second filter; and detecting the ions filtered by the second filter plate.

BRIEF DESCRIPTION OF THE FIGURES

The invention is described in detail below with reference to the following figures.

DETAILED DESCRIPTION OF THE INVENTION

Before describing the invention in detail, it must be noted that, as used in this specification and the appended claims, the singular forms "a," "an," and "the" include plural referents unless the context clearly dictates otherwise. Thus, for example, reference to "a layer" includes more than one "layer", reference to "a substrate" includes more than one "substrate".

In describing and claiming the present invention, the following terminology will be used in accordance with the definitions set out below.

The term "mesh plate" refers to any plate, mesh or material for creating an electric field for directing ions in a defined direction.

The term "filter plate" refers to any plate, device or material capable of being used to separate ions from stray ions or neutrals.

The term "guard plate" refers to any plate, device, ion optics ion guide or material used for moving ions from one position to another.

The term "ion extraction pulser" refers to a device or system capable of extracting, directing and quantifying ions using a pulse and electric field. The device may use or employ one or more filter or guard plates.

The term "ion optics" refers to an optional device for moving, transporting or directing ions.

The term "detector" refers to any device or apparatus that may be used for detecting, quantifying or identifying ions. This may be done by determining mass to charge ratio.

The term "ion source" refers to any ion sources used in mass spectrometry that may produce ions. This may include ion sources that are continuous in producing ions and sources that are non-continuous. For instance, continual ion source may comprise and not be limited to electrospray ionization (ESI), electron impact (EI), chemical ionization (CI), photo-ionization (PI). These sources may or may not be in a vacuum. Non-continuous ion sources may comprise and not be limited to matrix assisted laser desorption ionization (MALDI), and atmospheric pressure matrix assisted laser desorption ionization (AP-MALDI) etc. Other ion sources known in the industry may also be employed.

Figure 1:
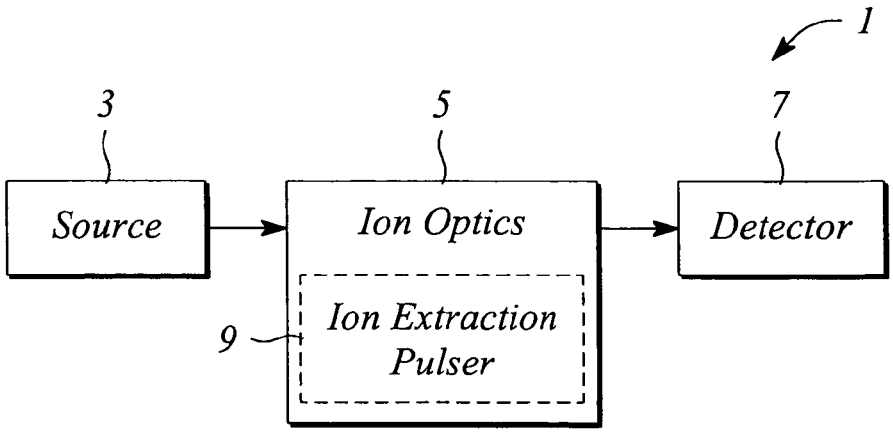
FIG. 1 shows a general block diagram of the present invention.

FIG. 1 shows a general block diagram of the present invention. It should be noted that the diagram is not to scale and is provided for illustration purposes only. The diagram in no way should be interpreted to limit the broad scope of the present invention. FIG. 1 shows the mass spectrometry system 1 of the present invention. The mass spectrometry system 1 comprises an ion source 3, an ion optics system 5 with ion extraction pulser 9 and a detector 7.

The ion source 3 of the present invention may comprise any number of ion sources known and/or used in the art for identifying, characterizing and quantifying molecules. For instance, the ion source may comprise an AP-MALDI, a MALDI, an EI, a CI, an APPI and other sources known in the art. In fact, the present invention will work with any ion source that produces ions. The invention should not be interpreted to be limited to the above mentioned ions sources.

Other ion sources not discussed or mentioned may also be employed with the present invention.

Figure 2:
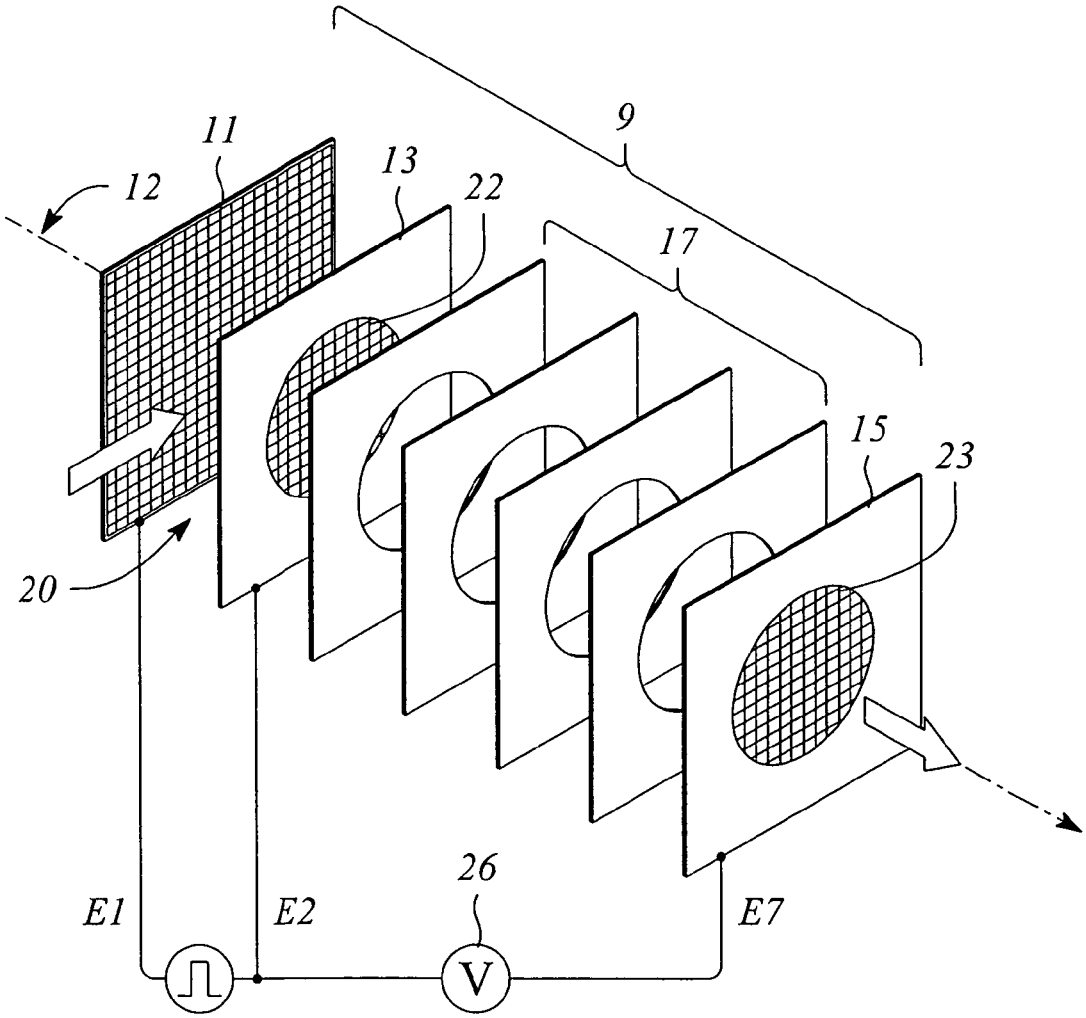
FIG. 2 shows a first embodiment of the present invention.
Figure 3:
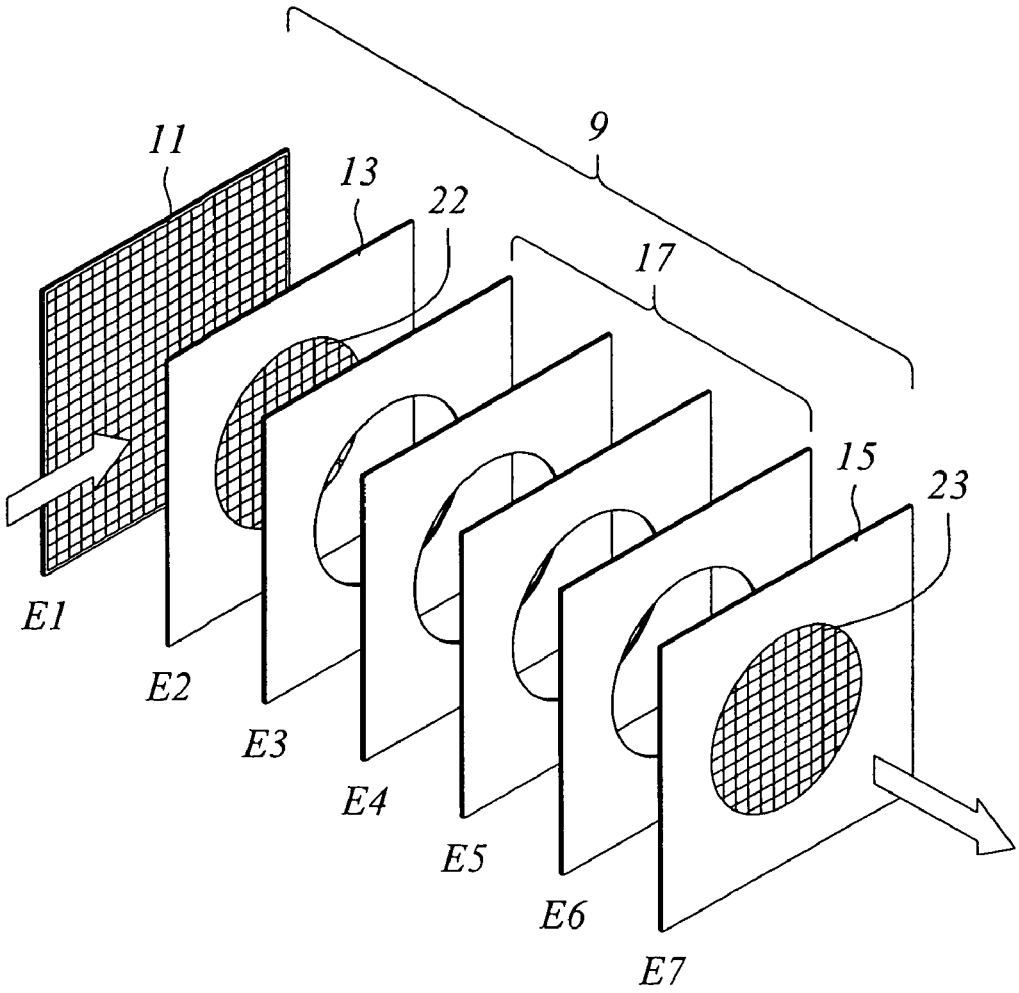
FIG. 3 shows a second embodiment of the present invention.
Figure 4:
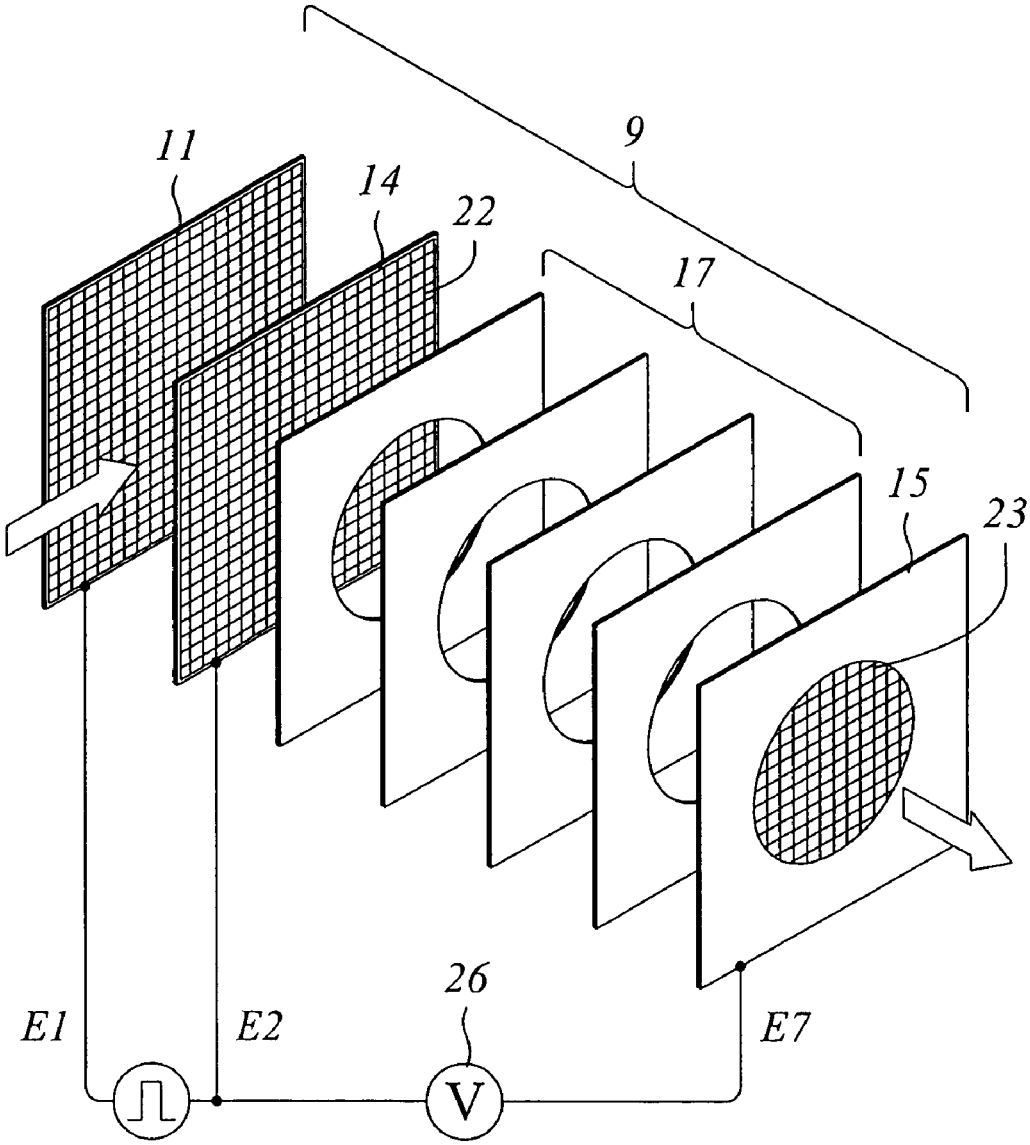
FIG. 4 shows a third embodiment of the present invention.

The ion extraction pulser 9 of the present invention is further described and shown in FIGS. 2-4. The ion extraction pulser 9 may be used with one or more optional ion guides, skimmers or other types of devices for directing and/or moving ions (not shown in the FIGS.).

Detector 7 may comprise any number of detectors known in the art. For instance, the detector 7 may comprise a time-of-flight detector (TOF). In addition, the detector 7 may comprise any other device known in the art for detecting, characterizing and quantifying ions. Other detectors may comprise and not be limited to quadrupole mass filters, ion trap devices, orbitrap, Fourier transfer ion cyclotron devices, linear ion trap devices, Q-TOF detectors, and other type detectors know and employed in the mass spectrometry field. In addition, optional photomultipliers and similar type device may be employed with the detector(s).

Figure 5:
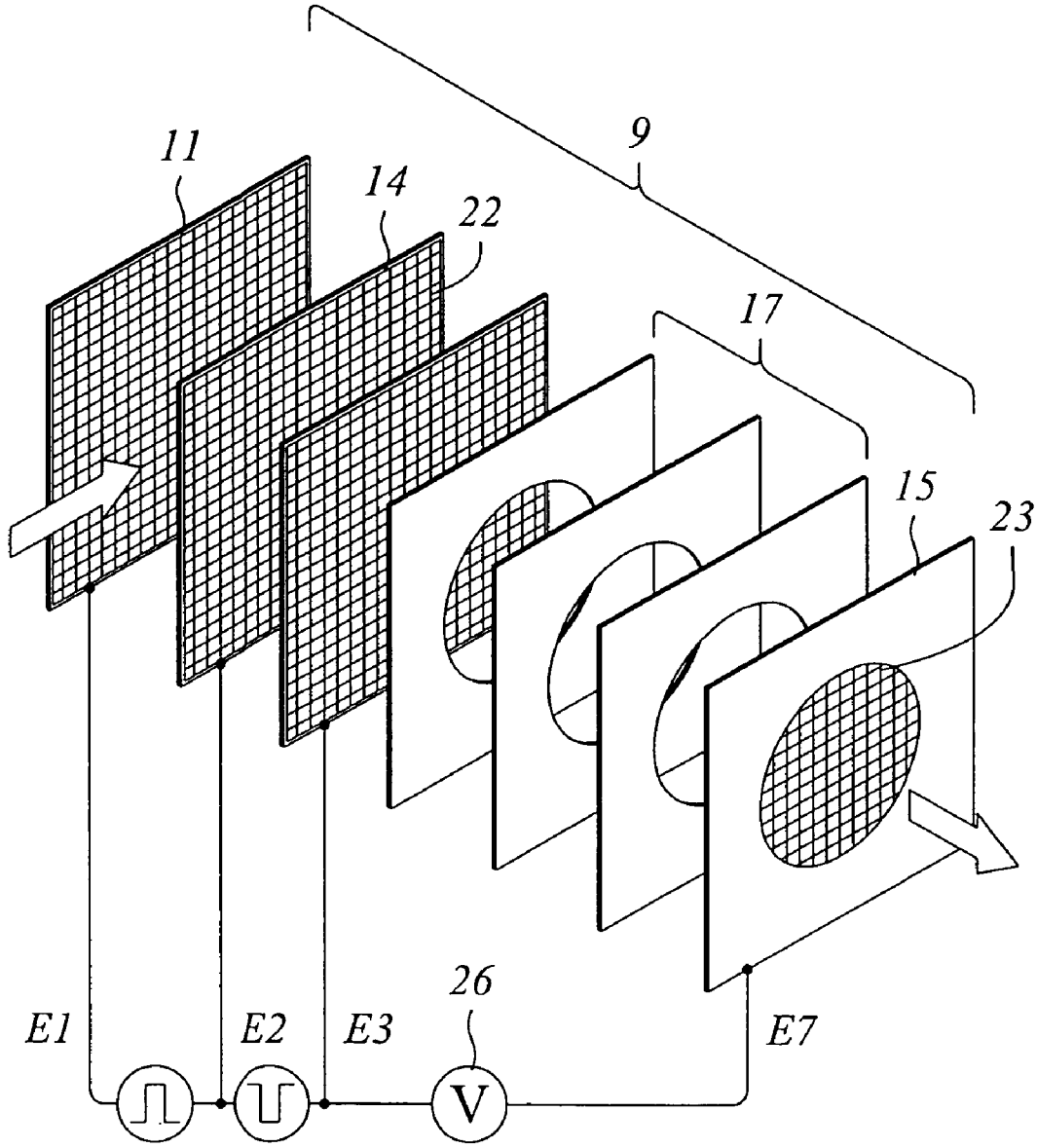
FIG. 5 shows an ion pulsar in accordance with a representative embodiment.

The ion optics system 5 with ion extraction pulser 9 of the present invention will now be discussed in more detail. The ion extraction pulser 9 comprises a mesh plate 11, a filter plate 13, and one or more guard plate(s) 17. An optional second filter plate 15 may be employed with the present invention. In addition, a plurality of filter plates and/or guard plates may be employed with the present invention. It is important to the invention that the mesh plate 11 be positioned at one end of the ion pulser 9. Various positions, combinations and locations of the filter and guard plates are possible. See FIGS. 3-5.

The mesh plate 11 may comprise any number of materials that are electrically conductive. The mesh plate 11 allows for the ability to efficiently create an electric field and field region 20 for directing ions. The mesh plate 11 comprises a mesh plate central axis 12. The mesh plate central axis 12 passes through the mesh plate 11. The mesh plate 11 allows for efficient ways to conduct electricity. The mesh plate 11 may comprise any number of distances between contacts on the plate. For instance, the mesh plate may comprise any number of plates for producing an electric field.

The filter plate 13 is disposed downstream from the mesh plate 11. The filter plate 13 comprises any number of materials know in the art for filtering ions. For instance, in the illustrated embodiments an optional mesh area 22 is provided for filtering ions. The mesh area 22 may comprise any number of shapes or sizes. For instance, the mesh area 22 in the figure is shown as being circular in design. Ideally, ions are passed through filter plate 13. Some pass through while others are filtered away by the outside portion of the plate 24.

The guard plate 17 is disposed downstream from the filter plate 13. The guard plate 17 may comprise any number of shapes and sizes. The guard plate 17 is particularly designed for moving and transporting ions from one position or location to another. The guard plate 17 may comprise any number of materials known in the art for constructing or designing such plates. FIGS. 2-5 show multiple guard plates in the diagram. This is a not a requirement of the invention since only one guard plate needs to be employed. However, in certain embodiments, multiple guard plates may be employed as shown in the figure.

The second filter plate 15 is disposed downstream from the guard plate 17. The second filter plate 15 may comprise any number of materials known in the art for filtering ions. For instance, the optional mesh area 23 in the figure is shown as being circular in design. Ideally, ions are passed through the filter plate 13. Some pass through while others are filtered away by the outside portion of the plate 24. As discussed above the mesh area 23 may comprise any number of shapes and sizes.

As shown in FIGS. 2-4 the ion extraction pulser 9 may be electrically connected in a few different ways. For instance, FIG. 3 shows each of the filter plates and guard plates having separate electrical connections. FIG. 2 shows the mesh plate 11, the first filter plate 13 and the second filter plate 15 in electrical connection. A voltage source 26 is supplied. The voltage source 26 provides the potential gradient between filter plate 13 and filter plate 23. The electric pulse source 27 provides for the electric pulse between the mesh plate 11 and the filter plate 13. The electrical design allows for the creation of an electrical field region 20 between the mesh plate 11 and the first filter plate 13. The ions are introduced into the electrical field region 20 by way of an ion beam. They are then redirected through the first filter plate 13, the guard plate 17 and then the second filter plate 15. This is typically accomplished through the application of one or more pulses applied by the electric pulse source 27 to the mesh plate 11. In order to assume good resolution power in a time-of-flight mass spectrometer, the electrical pulse applied to E1 (mesh plate 11), has to be a sharp rise of potential difference between E1 and E2 (filter plate 13). In most cases it is not uncommon for the potential to reach over one thousand volts within a sub-microsecond.

FIG. 3 shows another embodiment of the invention in which the E1, E2 and E7 electrodes are in electrical connection to voltage source 26 and electric pulse source 27. In this embodiment of the invention a second mesh plate 14 may be employed.

FIG. 4 shows another embodiment where a third mesh plate 16 and second electric pulse source 28 may also be employed. These embodiments operate by extracting the ions as discussed above. However, the second mesh plate 14 and the third mesh plate 16 may operate to create an electric field that pushes the ions forward and through the one or more guard plates 7.

EXAMPLE 1

A typical time-of-flight mass spectrometer using the geometric and electric dimensions of the ion pulser of the present invention may employ the following parameters:

Dimension of electrodes E1 and E2: 60 mm×50 mm

Distance between electrodes E1 and E2: 3 mm

Electrical pulse Vc: 0-1500 volts

Rise time of electric pulse Tc: 250 ns

The electrical capacitance formed by electrodes E1 and E2 is given by:

$$C=\epsilon_0 A/D=8.85\times10^{-12}[\mathrm{F/m}]\times0.06\times0.05[\mathrm{m}^2]/0.003[\mathrm{m}]=8.85\times10^{-12}[\mathrm{F}]$$

where $\epsilon_0$ is the dielectric constant in vacuum and A is the area of E1 and E2 and D is the distance between E1 and E2. The power P required to achieve a potential difference $V_c$ of 1500 volts between E1 and E2 within a time $t_c$ of 250 nanoseconds is given by:

$$P=V_c^2\times2\pi C/t_c=1500^2[\mathrm{V}^2]\times2\pi\times8.85\times10^{-12}[\mathrm{F}]/2.5\times10^{-7}[\mathrm{s}]=500[\mathrm{watts}]$$

As shown in the example a number of parameters may vary. For instance, voltages can range from 300-3000 volts. This results in a power of from 100 to 1000 watts. Other voltages are possible and the invention should not be interpreted to be limited to the disclosed examples. The pulse supplied to the invention may vary. However, pulses can be in the range of from 50 nanoseconds to 1 microsecond. The longer the time, the less the power and vice versa. Mesh plates used in the invention can vary. For instance, the surface area (A) can range from about 100 to 5000 $mm^2$. The present invention can be used to extract both positive and negative ions. This can be accomplished by reversing the polarity of the power supply.

As further described above, the present invention and ion extraction pulser 9 is quite different from other similar type instruments or pulsers. For instance, the other type inventions employ a corporeal electrode E1. The present invention replaces this type of electrode with an electrode that substantially comprises a conductive mesh plate. The mesh plate provides for substantially less capacitance in combination with electrode two (E2). The pulsed electrical field generated using the invented device is nevertheless similar to the one generated by the traditional type pulser. However, using a mesh plate has about 6% of the conductive area in comparison with a corporeal electrode. As a result, the capacitance of the ions pulser provided by the present invention is about 94% lower in comparison to conventional configurations. Consequently, the power needed for generating a similar pulsed field is only 6% of 500 watts, or 30 watts. Details of a similar type mesh plate can be found in U.S. Pat. No. 6,717,133.

Having discussed the apparatus of the present invention, a description of the method is now in order. Referring now to FIGS. 1-3, the method of the invention will now be discussed in more detail. Initially, ions are created at the ion source 3. They are then directed via ion optics 5 toward the ion extraction pulser 9. The ion extraction pulser 9 creates an electric field that redirects a portion of the ions. In the FIGS. 1-3 the ions and are directed along the longitudinal axis 12 which is orthogonal to the entry direction of the ions. It should be noted that this is not a requirement of the invention. The ions and ion beam may be directed or introduced to the ion extraction pulser 9 from a variety of directions, angles and locations. In certain embodiments of the invention it can be imagined that the ions are actually created within the ion extraction pulser 9. Other embodiments or the invention may also be possible. As discussed, the mesh plate 11 and first filter plate 13 create an electric field that redirects the ions toward the first filter plate 13. The first filter plate 13 then operates to remove neutrals and other ions that scatter away from the longitudinal axis 12. A portion of the ions pass through the first filter plate 13. After passing through the first filter plate 13, the ions are then moved by the guard platel7. The guard plate 17 (note that one or more plates may be employed) directs the ions through the second filter plate 15. Second filter plate 15 then serves to further process and/or filter the ions and ion beam. As discussed other filter and guard plates may be employed in various positions after the mesh plate 11.

FIG. 2 shows a first embodiment of the present invention. In this embodiment of the invention, separate voltage sources 26 and 27 are electrically connected to each of the filter plates, mesh plate(s) and guard plates. Various numbers of plates and electrical connections may be employed with the present invention.

FIGS. 3 and 4 operate similar to the embodiments discussed above. However, the added mesh plates 14 and/or 16 operate to push or move the ion through the guard plates 7. This works to move ions in a push and pull fashion.

For instance, FIG. 3 shows a second embodiment of the invention in which the filter plate 13 is replaced by the mesh plate 14. The combination of mesh plate 11 and mesh plate 14 provides an even lower capacitance in comparison to the embodiment shown in FIG. 2. The power required to operate the device in FIG. 3 is further reduced.

FIG. 4 shows an embodiment of the invention employed to "push and pull" ions. For instance, the mesh pate 16 and second electric pulse power supply 28 has been added to the device. This embodiment of the invention comprises mesh plates 11, 14 and 16. Second electric pulse power supply 28 has an opposite electric polarity to power supply 27. It should be noted that the mesh plates 11, 14 and 16 and the power supplies 27 and 28 are employed in creation of the "push and pull" function.

The various methods above follow a very similar process. The method for extracting and filtering ions from an ion beam comprises introducing an ion beam into a field region disposed between a mesh plate and a filter plate; applying a pulse to the mesh plate to direct the ions toward the filter plate for filtering; filtering the ions using the filter plate; moving the resulting filtered ions with a guard plate; filtering the moved ions using a second filter; and detecting the ions filtered by the second filter plate.

We claim:

1. An ion extraction pulser for mass spectrometry, comprising:

(a) a mesh plate for applying an electric pulse for extracting ions from an ion beam;

(b) a first filter plate adjacent to the mesh plate for filtering ions extracted by the mesh plate;

(c) an electric pulse power supply for providing a voltage different between the mesh plate and the first filter plate;

(d) a guard plate adjacent to the first filter plate for further directing ions filtered by the first filter plate;

(e) a second filter plate adjacent to the first guard plate for further filtering ions directed from the guard plate; and (f) a voltage source for providing a voltage difference between the first filter plate and the second filter plate, wherein ions are extracted, filtered and directed by the ion extraction pulser.

2. An ion extraction pulser as recited in claim 1, further comprising a second guard plate adjacent to the first guard plate.

3. An ion extraction pulser as recited in claim 1, wherein the first filter plate comprises a mesh plate.

4. An ion extraction pulser as recited in claim 1, further comprising a longitudinal axis in which the ions are extracted.

5. An ion extraction pulser as recited in claim 1, further comprising a detector for detecting ions.

6. An ion extraction pulser as recited in claim 1, further comprising a second mesh plate disposed between the first mesh plate and the guard plate.

7. An ion extraction pulser as recited in claim 1, further comprising a second electric pulse power supply for supplying a voltage difference to the first filter plate and the second mesh plate.

8. An ion extraction pulser as recited in claim 7, wherein the detector comprises a time-of-flight detector, a quadrupole mass filter, an ion trap device, an orbitrap, a Fourier transfer ion cyclotron devices, a linear ion trap device and a Q-TOF detector.

9. An ion extraction pulser as recited in claim 5, wherein the voltage of the electric pulse is from 300 to 3000 volts.

10. An ion extraction pulser as recited in claim 5, wherein the rise time of the electric pulse is from about 50 to 100 nanoseconds.

11. An ion extraction pulser as recited in claim 5, wherein the first filter plate has a surface area for removing ions.

12. An ion extraction pulser as recited in claim 11, wherein the surface area is from 100 to 5000 $mm^2$.

13. A mass spectrometry system, comprising:

an ion extraction pulser for selecting and directing ions, the ion pulser comprising: a mesh plate to which a voltage a pulse is applied to extract ions from an ion beam; a first filter plate adjacent to the mesh plate and configured to filter ions extracted by the mesh plate; a guard plate adjacent to the first filter plate and configured to direct ions filtered by the first filter plate; and a second filter plate adjacent to the first guard plate and configured to further filter ions directed from the guard plate; a voltage source for providing a voltage difference between the first filter plate and the second filter plate, wherein ions are extracted, filtered and directed by the ion extraction pulser; and a detector in tandem with the ion extraction pulser.

14. A mass spectrometry system, as recited in claim 13, wherein the ion source comprises a continual ion source.

15. A mass spectrometry system as recited in claim 13, wherein the ion source comprise a non-continual ion source.

16. A mass spectrometry system, as recited in claim 15, wherein the ion source comprises an AP MALDI source.

17. A mass spectrometry system as recited in claim 15, wherein the ion source comprises a MALDI ion source.

18. A mass spectrometry system as recited in claim 14, wherein the ion source comprises an ESI source.

19. A mass spectrometry system as recited in claim 14, wherein the ion source comprises an EI ion source.

20. A mass spectrometry system as recited in claim 14, wherein the ion source comprises a CI ion source.

21. A mass spectrometry system as recited in claim 14, wherein the ion source comprises an APPI ion source.

22. A mass spectrometry system as recited in claim 14, wherein the ion source comprises an APCI ion source.

23. A mass spectrometry system as recited in claim 14, wherein the ion source comprises PI.

* * * * *

UNITED STATES PATENT AND TRADEMARK OFFICE

CERTIFICATE OF CORRECTION

PATENT NO. : 7,619,213 B2
APPLICATION NO. : 11/499177
DATED : November 17, 2009
INVENTOR(S) : Gangqiang Li It is certified that error appears in the above-identified patent and that said Letters Patent is hereby corrected as shown below:

On the Title page, in Item (57), under "Abstract", in column 2, line 16, after "plate" insert -- . --.

In column 6, line 65, in Claim 13, after "voltage" delete "a".

In column 7, line 16, in Claim 16, delete "AP MALDI" and insert -- AP-MALDI --, therefor.

Signed and Sealed this

Ninth Day of February, 2010

David J. Kappos

David J. Kappos
*Director of the United States Patent and Trademark Office*